US006277086B1

(12) United States Patent
Wu

(10) Patent No.: US 6,277,086 B1
(45) Date of Patent: Aug. 21, 2001

(54) MASSAGING BATH MAT WITH AIR BUBBLE GENERATING ARRANGEMENT

(76) Inventor: Shu Chih Wu, 9F., No. 585, Chung Cheng Rd., Yung Ho City Taipei, Hsien (TW)

( * ) Notice: Subject to any disclaimer, the term of this patent is extended or adjusted under 35 U.S.C. 154(b) by 0 days.

(21) Appl. No.: 09/461,572

(22) Filed: Dec. 14, 1999

(51) Int. Cl.[7] ..... A61H 19/00
(52) U.S. Cl. ..... 601/168; 601/158; 601/159
(58) Field of Search ..... 601/154, 156, 601/157, 158, 159, 160, 167, 168, 169

(56) References Cited

U.S. PATENT DOCUMENTS 4,774,934 * 10/1988 Hara ..... 601/157
4,957,101 * 9/1990 Hara ..... 601/167

FOREIGN PATENT DOCUMENTS

404256750 * 9/1992 (JP) ..... 601/157
404279163 * 10/1992 (JP) ..... 601/157

* cited by examiner

*Primary Examiner*—Michael A. Brown
*Assistant Examiner*—Benjamin K. Koo
(74) *Attorney, Agent, or Firm*—Pro-Techtor International Services

(57) ABSTRACT

A massaging bath mat, which includes a bath mat for mounting in the inside wall of a bathtub under the water, the bath mat being formed of a series of bath mat units each having a plurality of perforated flexible tubes connected in parallel, and a pump unit coupled to the bath mat and controlled to pump air to the perforated flexible tubes of the bath mat for producing air bubbles in the water in the bathtub to massaging the user.

3 Claims, 9 Drawing Sheets

MASSAGING BATH MAT WITH AIR BUBBLE GENERATING ARRANGEMENT

BACKGROUND OF THE INVENTION

The present invention relates to a massaging bath mat, and more specifically to such a massaging bath mat, which is designed for use in the bathtub for generating air bubbles to massage the user when the user having a bath in the bathtub.

A regular bathtub is simply an open vessel for bathing. Recently, various massaging bathtubs have been disclosed, and have appeared on the market. These massaging bathtubs are commonly expensive, not every family can afford. Further, the maintenance cost of these massaging bathtubs is high.

SUMMARY OF THE INVENTION

It is one object of the present invention to provide a massaging bath mat, which is to be used in a bathtub to produce air bubbles for massaging the user. It is another object of the present invention to provide a massaging bath mat, which emits a good smell when producing air bubbles in the water in the bathtub. It is still another object of the present invention to provide a massaging bath mat, which is inexpensive to manufacture. According to one aspect of the present invention, the massaging bath mat comprises a bath mat for mounting in the inside wall of a bathtub under the water, the bath mat being formed of a series of bath mat units each having a plurality of perforated flexible tubes connected in parallel, and a pump unit coupled to the bath mat and controlled to pump air to the perforated flexible tubes of the bath mat for producing air bubbles in the water in the bathtub to massaging the user. According to another aspect of the present invention, perfume dispenser means is installed in the pump unit to emit a good smell into the flow of air being pumped to the perforated flexible tubes.

DETAILED DESCRIPTION OF THE PREFERRED EMBODIMENT

Figure 1:
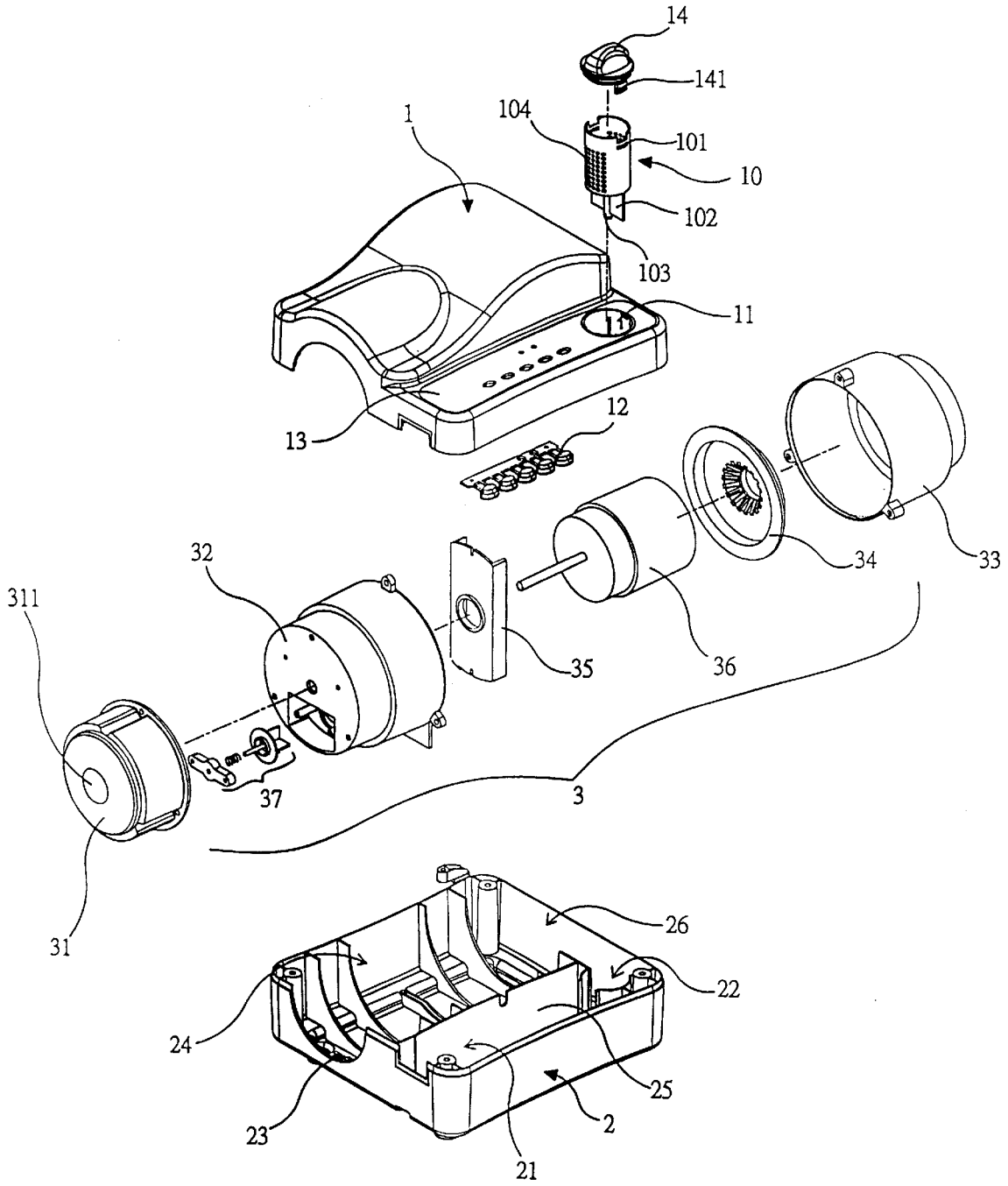
FIG. 1 is an exploded view of a pump unit for a massaging bath mat according to the present invention.

Referring to FIG. 1, a pump unit is shown comprised of a top cover shell 1, a bottom cover shell 2, and a motor assembly 3. The top cover shell 1 comprises a control panel 13, a plurality of control buttons 12 installed in the control panel 13, a receiving hole 11 formed integral with the control panel 13, a perfume container 10 mounted in the receiving hole 11, the perfume container 10 comprising a plurality of air vents 104 through which the good smell of the perfume contained in the perfume container 10 is dissipated into the air, a bottom axle 103 for positioning in a hole inside the bottom cover shell 2, two opposite bottom locating flanges 102, which limits the rotation of the perfume container 10 in the receiving hole 11 to 90° angle in clockwise direction as well as counter-clockwise direction, and two opposite locating top notches 101, and a knob 14 covered on the perfume container 10 for turning by hand to rotate the perfume container 10. The knob 14 comprises two opposite bottom hooks 141 respectively hooked in the locating top notches 101. The bottom cover shell 2 comprises a partition means 25, which separates the holding space of the bottom cover shell 2 into a first suction chamber 21, a second suction chamber 26, a motor chamber 24, which receives the motor assembly 3, a receiving chamber 22 which receives the perfume container 10, and a plurality of air inlets 23. The motor assembly 3 is comprised of a rear cover 33, a front cover 32 covered on the rear cover 33, a check valve 37 mounted in the front cover 32 at a front side, a front cap 31 covered on the front cover 32 over the check valve 37, the front cap 31 having a center through hole 311, an axle bearing 35 and a muffler 34 mounted inside the front cover 32 and the rear cover 33, and a motor 36 mounted inside the front cover 32 and the rear cover 33 between the axle bearing 35 and the muffler 34. When the motor 36 is started, induced currents of air are compressed and driven through the center through hole 311 on the front cap 31 to the desired location.

Figure 2:
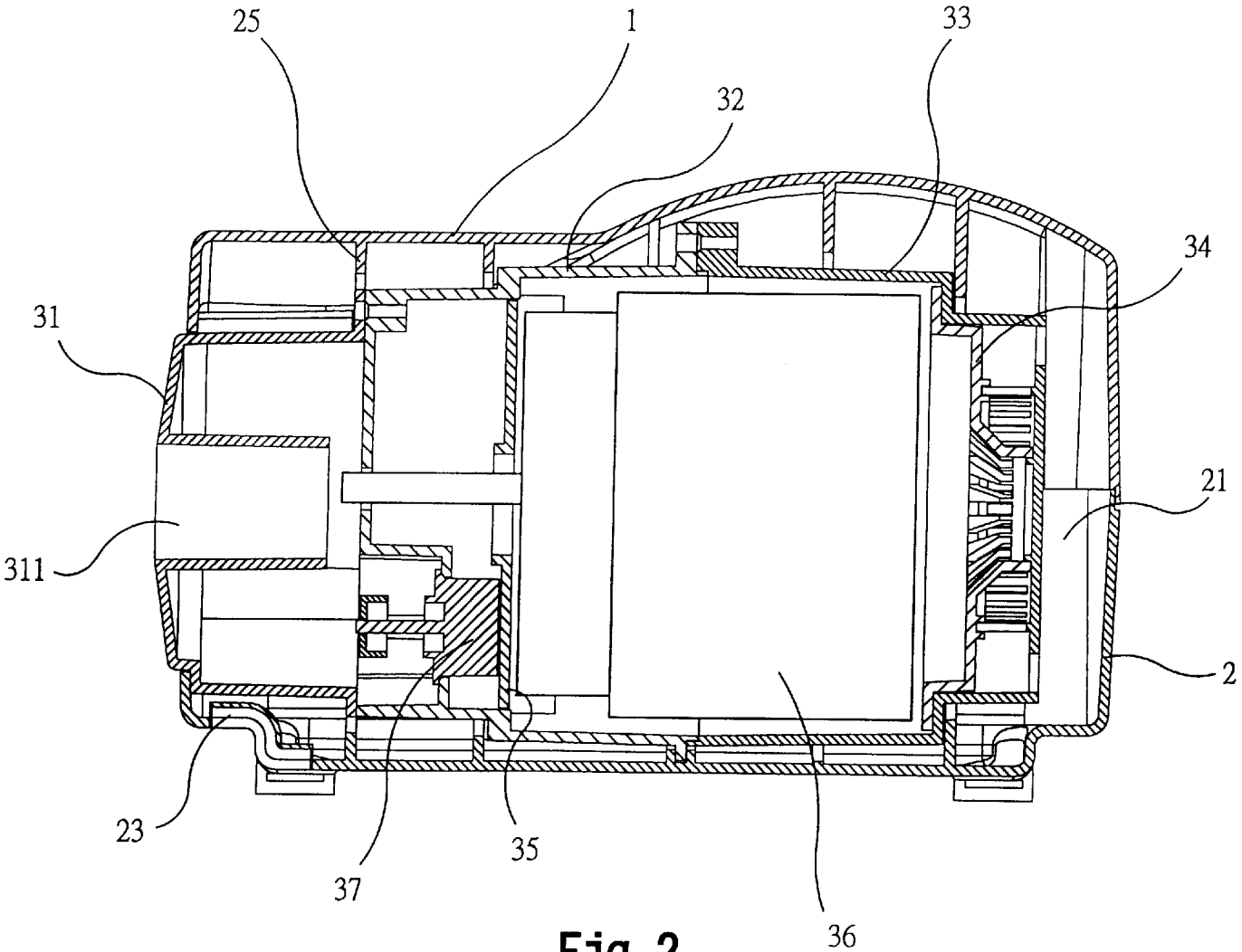
FIG. 2 is a longitudinal view in section of the pump unit for the massaging bath mat according to the present invention.

Referring to FIG. 2, the motor shaft of the motor 36 is supported in the axle bearing 35, and the check valve 37 is mounted in the front cover 32 at the front side to stop water or moisture from passing to the inside of the motor 36.

Figure 3:
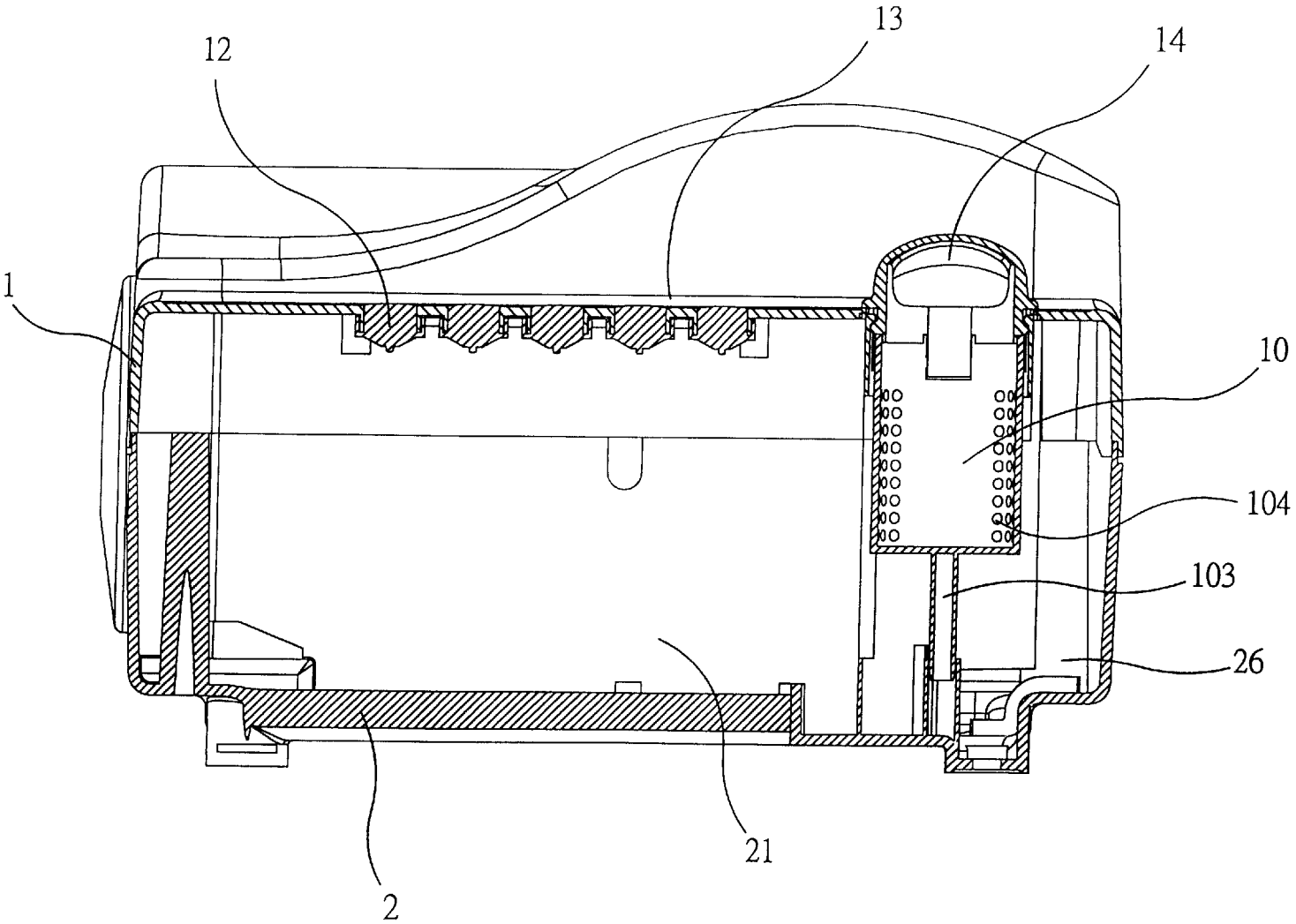
FIG. 3 is another longitudinal view in section of the pump unit for the massaging bath mat showing the arrangement of the perfume container in the top cover shell and the bottom cover shell.

Referring to FIG. 3, when the motor 36 is started, a flow of air is induced through the air inlets 23 into the first suction chamber 21 and then the second suction chamber 26, enabling the good smell of the perfume to be carried with the flow of air out of the air vents 104 on the perfume container 10, and then the intake flow of air is compressed by the motor 36 and forced out of the front cap 31 through the center through hole 311. As indicated above, the knob 13 can be turned by hand clockwise or counterclockwise through 90°. When the knob 13 is turned clockwise through 90°, the peripheral wall of the receiving hole 11 closes the air vents 104 on the perfume container 10. On the contrary, when he knob 13 is turned counter-clockwise through 90°, the air vents 104 on the perfume container 10 are released from the constraint of the peripheral wall of the receiving hole 11, enabling the good smell of the perfume to be dissipated out of the perfume container 10 through the air vents 104 into the second suction chamber 26 and then carried with the flow of air out of the pump unit.

Figure 4:
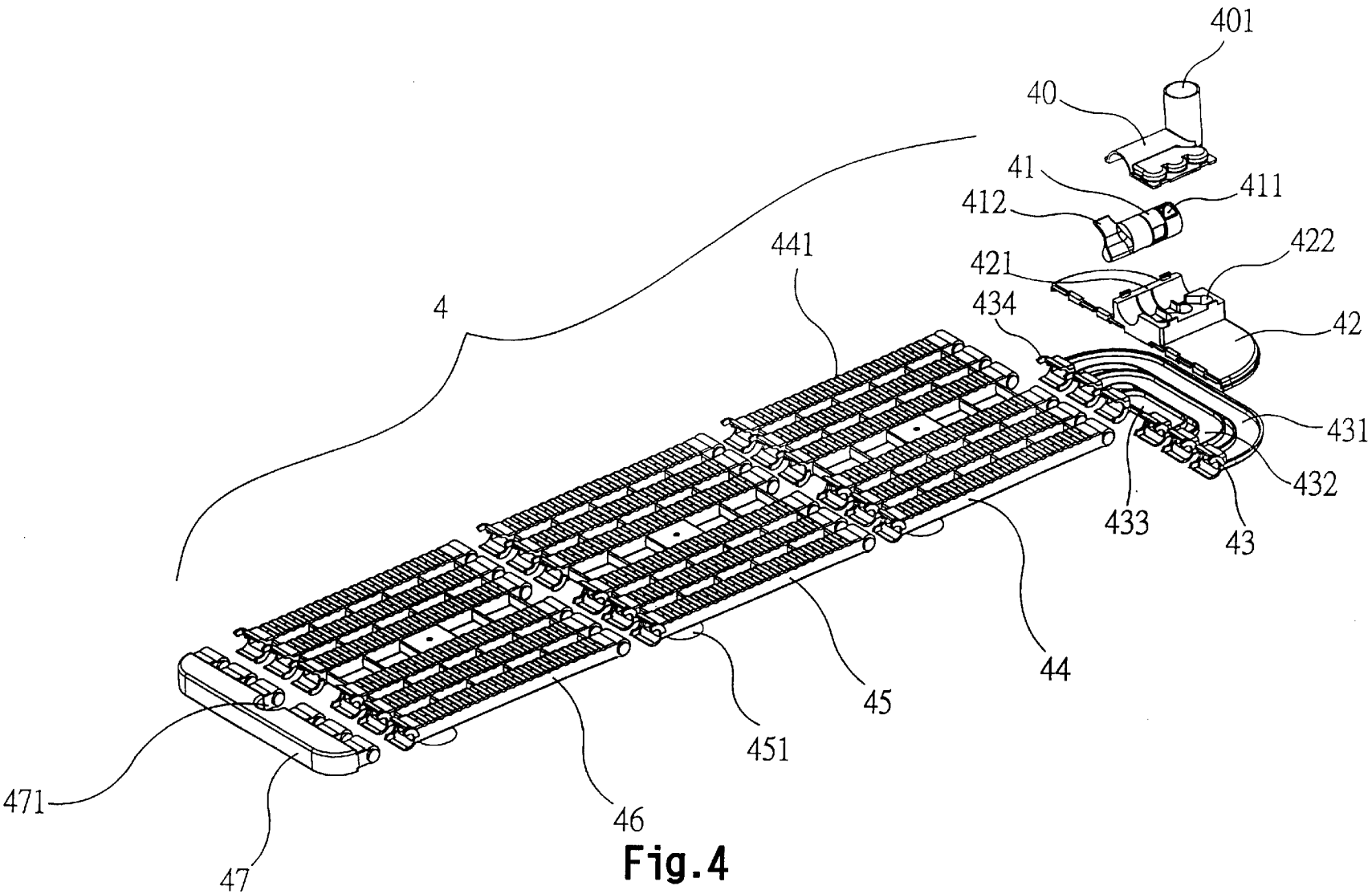
FIG. 4 is an exploded view of a bath mat for the massaging bath mat according to the present invention.
Figure 5:
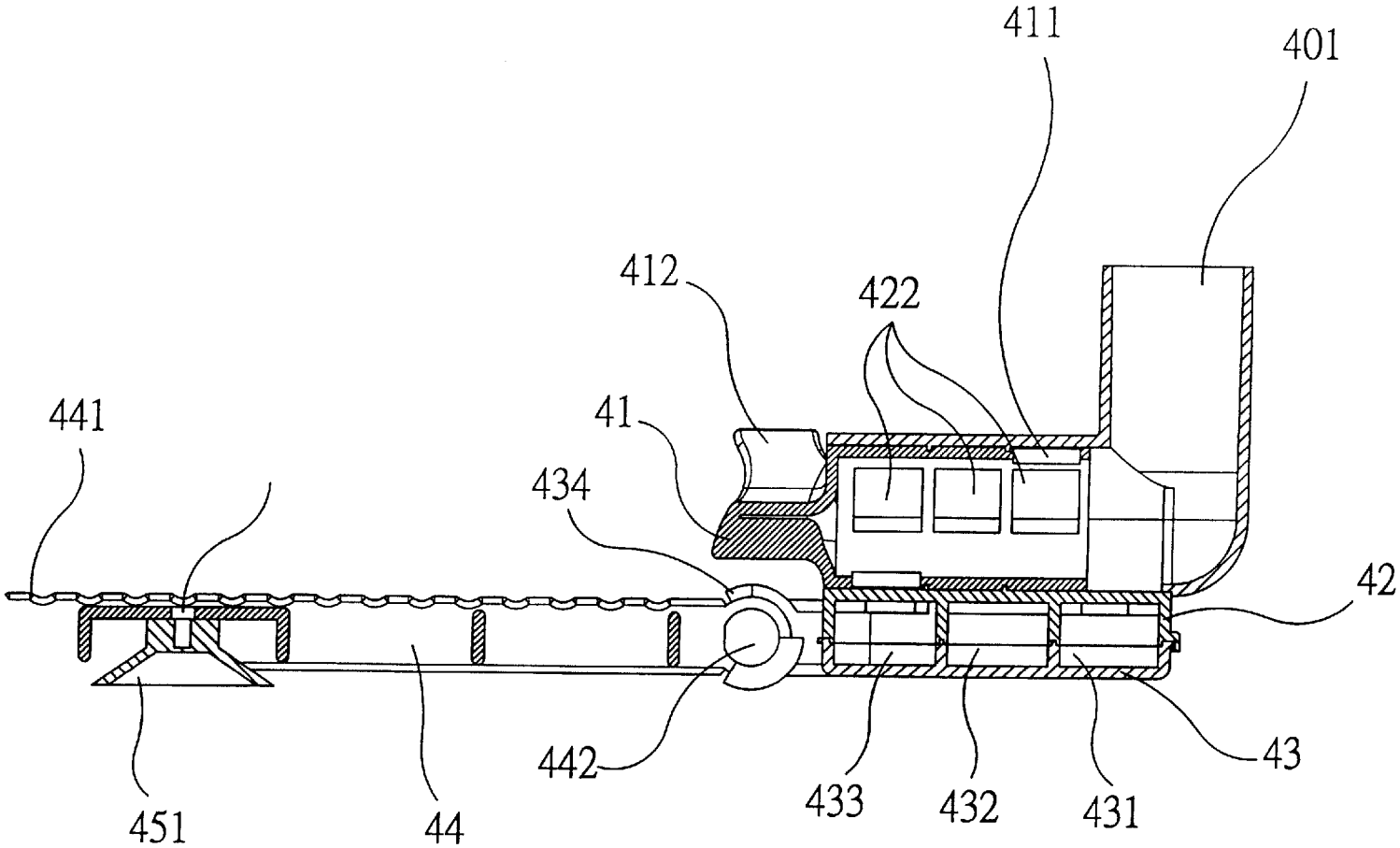
FIG. 5 is a longitudinal view in section of a part of the bath mat for the massaging bath mat according to the present invention.

Referring to FIGS. 4 and 5, a bath mat 4 is shown comprised of a valve cover 40, a distribution valve 41, a top flow guide shell 42, a bottom flow guide shell 43, a front mat unit 44, an intermediate mat unit 45, a rear mat unit 46, and a hanging board 47. The valve cover 40 is a smoothly arched shell having an upright inlet tube 401 at one side. The distribution valve 41 comprises three valve ports 411, and a rotary handle 412. The top flow guide shell 42 comprises a valve block 421 at the top side thereof, the valve block 421 having three air inlets 422 corresponding to the three valve ports 411 at the distribution valve 41. The bottom flow guide shell 43 comprises a first flow guide channel 431, a second flow guide channel 432, a third flow guide channel 433, and a plurality of arched clamps 434 respectively disposed at the ends of the flow guide channels 431, 432 and 433. The flow guide channels 431, 432 and 433 are respectively disposed in communication with the air inlets 422 at the top flow guide shell 42. The front mat unit 44 is formed of six perforated flexible tubes 441 connected in parallel. The perforated flexible tubes 441 each comprise a barrel 442 at one end pivoted to one arched clamp 434 at the bottom flow guide shell 432 for enabling air to pass from the flow guide channels 431, 432 and 433 into the perforated flexible tubes 441. The intermediate mat unit 45 is comprised of six perforated flexible tubes 451 connected in parallel. The rear mat unit 46 is comprised of six perforated flexible tubes 461 connected in parallel. The perforated flexible tubes 461 of the rear mat unit 46 are respectively pivoted to the perforated flexible tubes 451 of the intermediate mat unit 45, which are in turn respectively pivoted to the perforated flexible tubes 441 of the front mat unit 44. The coupling structure between the intermediate mat unit 45 and the front mat unit 44 as well as the coupling structure between the rear mat unit 46 and the intermediate mat unit 45 are same as that between the bottom flow guide shell 43 and the front mat unit 44, i.e., the front mat unit 44 comprises a plurality of barrels 442 at the front end thereof for pivotally coupling to the arched clamps 434 at the bottom flow guide shell 43, and a plurality of arched clamps 434 (same as the arched clamps 434 at the bottom flow guide shell 43) at the rear end thereof for pivotally coupling to the intermediate mat unit 45. The intermediate mat unit 45 and the rear mat unit 46 are identical to the front mat unit 44. The hanging board 47 is pivoted to one end of the rear mat unit 46, having a hanging hole 471 for hanging.

Figure 6:
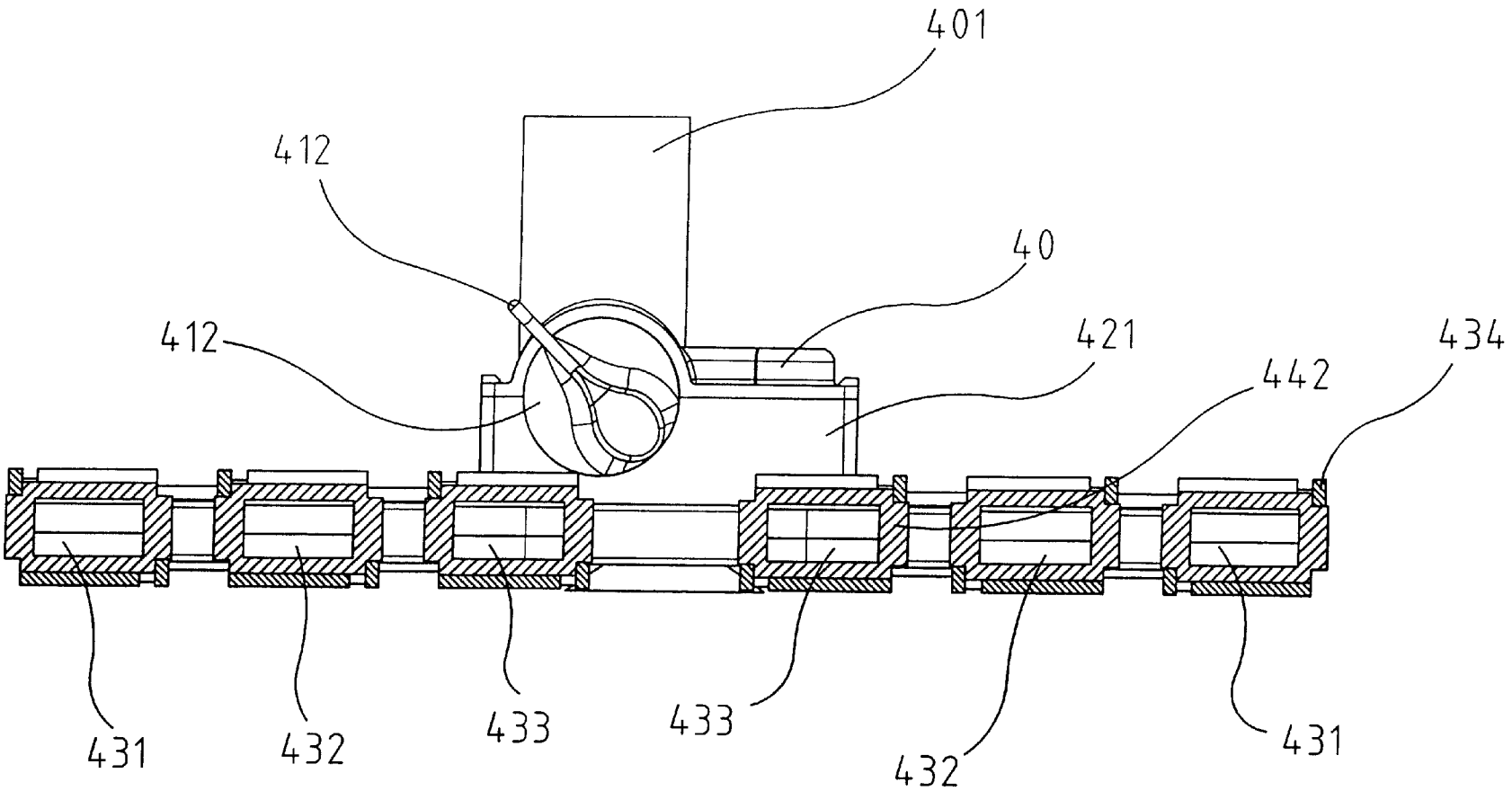
FIG. 6 is a transverse view in section of the bath mat for the massaging bath mat according to the present invention.
Figure 9:
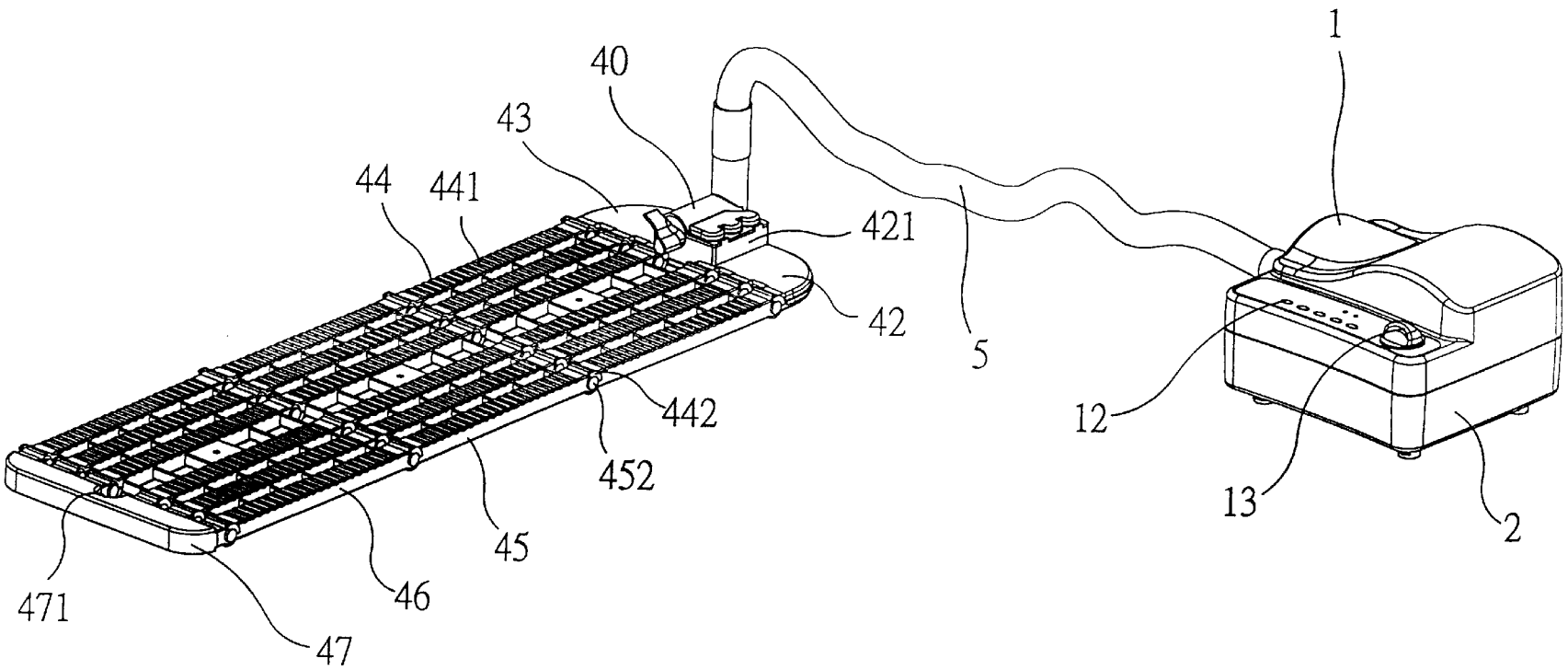
FIG. 9 is a perspective view of the massaging bath mat of the present invention.

Referring to FIGS. 6 and 9 and FIG. 5 again, the inlet tube 401 of the valve cover 40 is connected to the center through hole 311 on the front cap 31 of the motor assembly 3 through a hose 5 to receive compressed air from the pump unit. By means of rotating the rotary handle 412, the valve ports 411 are turned with rotary handle 412 between a first position where the valve ports 411 are disposed in communication with the first flow guide channel 431, a second position where the valve ports 411 are disposed in communication with the second flow guide channel 432, a third position where the valve ports 411 are disposed in communication with the third flow guide channel 433, and a fourth position where the valve ports 411 are disposed in communication with the three flow guide channels 431, 432 and 433. Furthermore, vacuum mounts 451 are provided at the bottom side of the front mat unit 45 for enabling the front mat unit 45 to be fastened to the inside wall of the bathtub.

Figure 7:
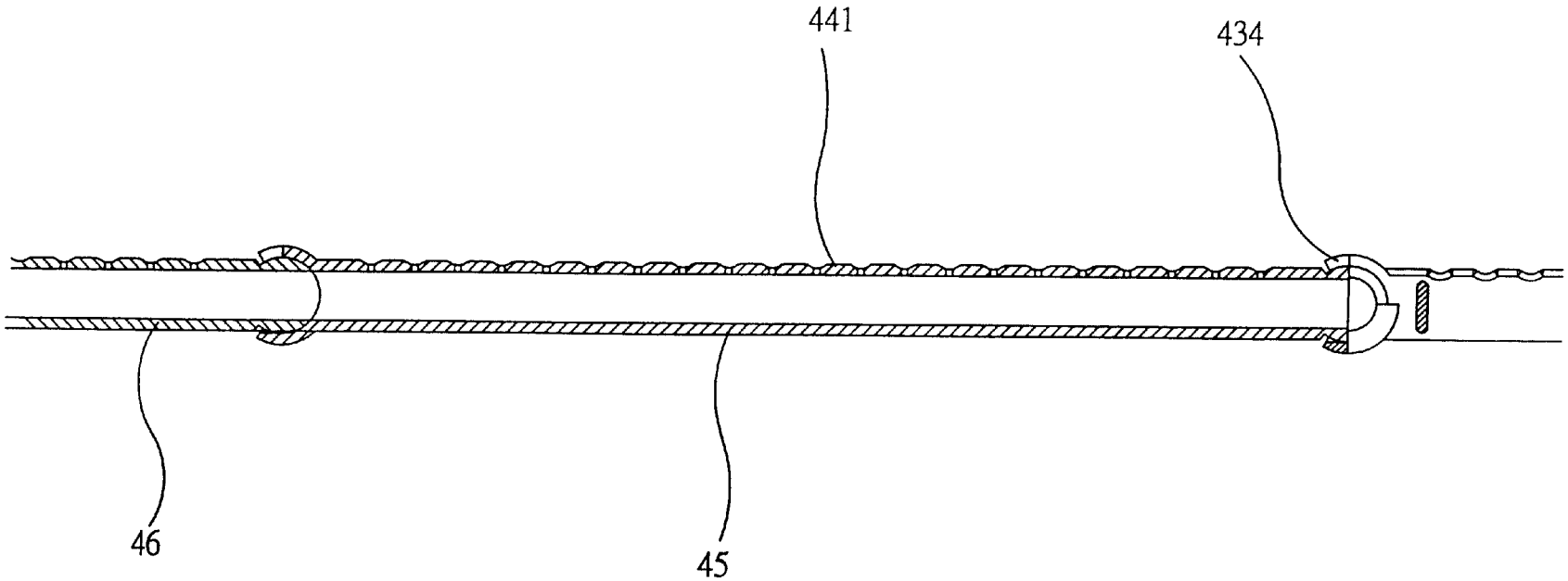
FIG. 7 is a sectional view in an enlarged scale of a part of the massaging bath mat showing the coupling of the intermediate mat unit between the front mat unit and the rear mat unit according to the present invention.
Figure 8:
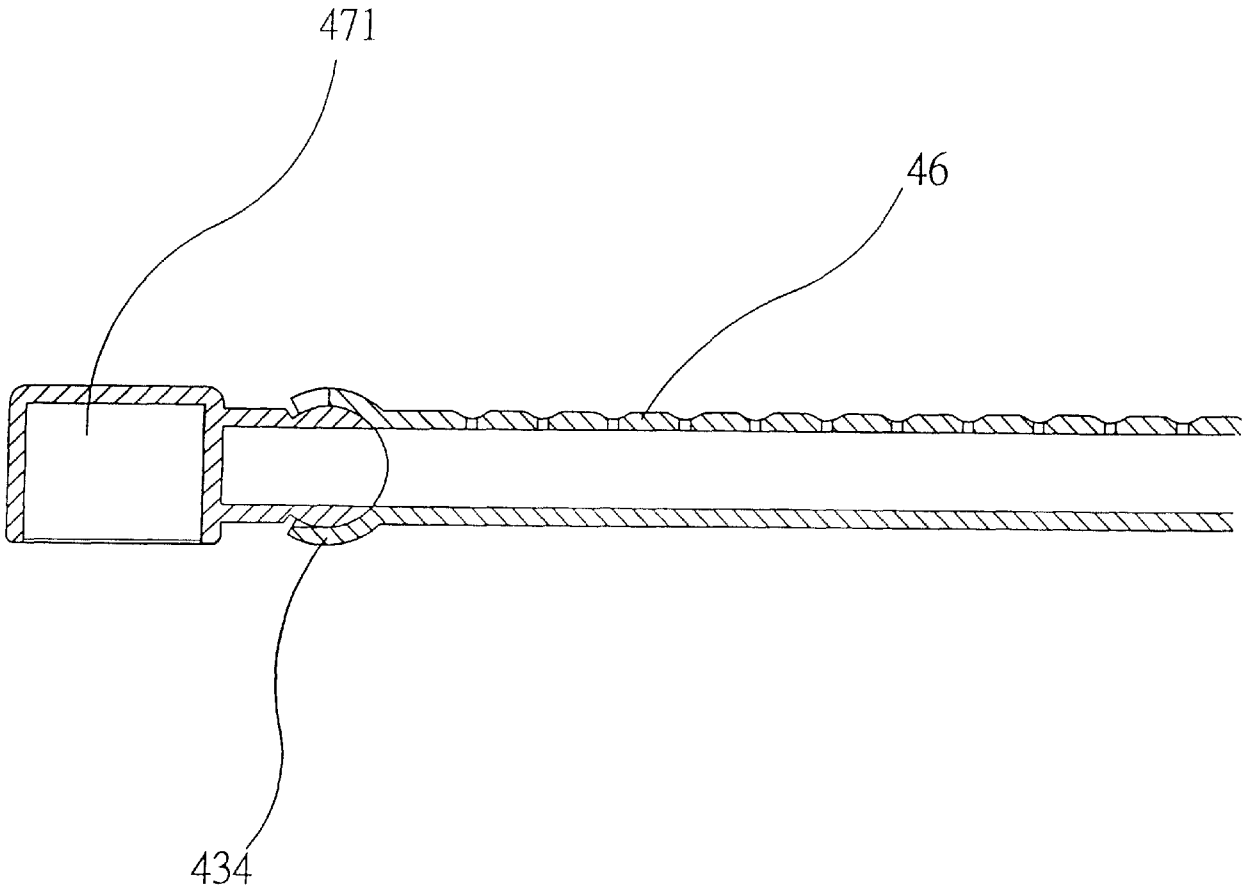
FIG. 8 is another sectional view in an enlarged scale of a part of the massaging bath unit showing the coupling between the hanging board and the rear mat unit according to the present invention.

Referring to FIGS. 7 and 8, as indicated above, the front mat unit 44, the intermediate mat unit 45 and the rear mat unit 46 are identical in structure, and connected in series between the bottom flow guide shell 43 and the hanging board 47. When not in use, the whole assembly of the massaging bath mat can be hung on the wall.

While only one embodiment of the present invention has been shown and described, it will be understood that various modifications and changes could be made thereunto without departing from the spirit and scope of the invention disclosed.

What the invention claimed is:

1. A massaging bath mat comprising a bath mat for mounting in the inside wall of a bathtub under the water, said bath mat having a plurality of air holes, and a pump unit coupled to said bath mat and controlled to pump air to the air holes of said bath mat for producing air bubbles in the water in the bathtub to massage the user; wherein said bath mat comprises a bottom flow guide shell, said bottom flow guide shell defining a first flow guide channel, a second flow guide channel, and a third flow guide channel;

a top flow guide shell covered on said bottom flow guide shell, said top flow guide shell comprising a valve block disposed at a top side thereof, and a plurality of air inlets respectively disposed in communication with said flow guide channels in said bottom flow guide shell;

a valve cover covered on said valve block at said top flow guide shell, said valve cover comprising an inlet tube connected to said pump unit to receive air pumped by said motor assembly;

a distribution valve mounted in said valve block, said distribution valve comprising a plurality of valve ports, and a rotary handle for turning by hand to move said valve ports between a first position where said valve ports are disposed in communication with said first flow guide channel, a second position where said valve ports are disposed in communication with said second flow guide channel, a third position where said valve ports are disposed in communication with said third flow guide channel, and a fourth position where said valve ports are disposed in communication with said flow guide channels of said bottom flow guide shell;

a series of mat units pivoted to said bottom flow guide shell, said mat units each comprising a plurality of perforated flexible tubes connected in parallel and respectively disposed in communication with said flow guide channels of said bottom flow guide shell.

2. The massaging bath mat of claim 1 wherein said pump unit comprises:

a bottom cover shell, said bottom cover shell comprising a plurality of air inlets, at least one air suction chamber respectively disposed in communication with said air inlets for receiving outside air, a motor chamber, a receiving chamber disposed in communication with said at least one air suction chamber;

a motor assembly mounted in said motor chamber in said bottom cover shell and controlled to pump air to the air holes on said bath mat;

a top cover shell covered on said bottom cover shell, said top cover shell comprising a receiving hole disposed in communication with the receiving chamber in said bottom cover shell, a control panel, and a set of control buttons for controlling the operation of said motor assembly; and a perfume container means mounted in the receiving hole on said top cover shell and the receiving chamber in said bottom cover shell, said perfume container means holding a perfume for giving a good smell into the air for pumping to the air holes on said bath mat by said motor assembly.

3. The massaging bath mat of claim 1 wherein said perfume container means comprises a container body holding a perfume, said container body having a plurality of air vents, and a rotary knob covered on said container body for turning by hand between a first position where the air vents on said container body are closed, and a second position where the air vents on said container body are opened.

* * * * *